United States Patent [19]

Cardoso

[11] 4,061,372

[45] Dec. 6, 1977

[54] SECONDARY LOCK FOR SLIDING DOOR OR WINDOW

[75] Inventor: LeRoy A. Cardoso, Sacramento, Calif.

[73] Assignee: Blomberg Glass, Sacramento, Calif.

[21] Appl. No.: 673,666

[22] Filed: Apr. 5, 1976

[51] Int. Cl.[2] ..... E05C 3/04

[52] U.S. Cl. ..... 292/207; 292/DIG. 46

[58] Field of Search ..... 292/202, 207, 209, DIG. 46, 292/DIG. 31, 337

[56] References Cited

U.S. PATENT DOCUMENTS

| | | | |
|---|---|---|---|
| 1,523,867 | 1/1925 | Davidson | 292/209 |
| 2,776,002 | 1/1957 | Conrad | 292/202 |
| 2,941,832 | 6/1960 | Grossman | 292/207 |
| 2,946,612 | 7/1960 | Ahlgren | 292/DIG. 38 |
| 3,250,558 | 5/1966 | McClintock | 292/DIG. 31 |
| 3,910,614 | 10/1975 | Coe | 292/228 |

*Primary Examiner*—Paul R. Gilliam
*Assistant Examiner*—Kenneth J. Dorner
*Attorney, Agent, or Firm*—Lothrop & West

[57] ABSTRACT

A sliding vent, such as a door or window, is slidable in a plane parallel to a fixed vent having a bottom rail of channel construction including a vertical panel adjacent the path of the sliding vent. A rectangular opening is cut through the panel into which is inserted and snap-fitted a housing having two parallel vertical walls extending into the interior of the fixed bottom rail. A stop plate is pivoted on the bottom edge of the opening and is rockable between an unlocked position in which the sliding vent clears the stop plate and a lock position in which the sliding vent is prevented from further movement by abutment of the bumper stile of the sliding door or window against the stop plate. In the lock position, a spring biased pin protudes from the stop plate and abuts the fixed bottom rail, thus preventing the stop plate from being moved to unlocked position. The stop plate is selectively moved to the unlocked position by pushing the pin into the stop plate until the pin clears the housing walls and then pivoting the stop plate into the housing until clearance is afforded between the sliding vent and the fixed vent.

9 Claims, 7 Drawing Figures

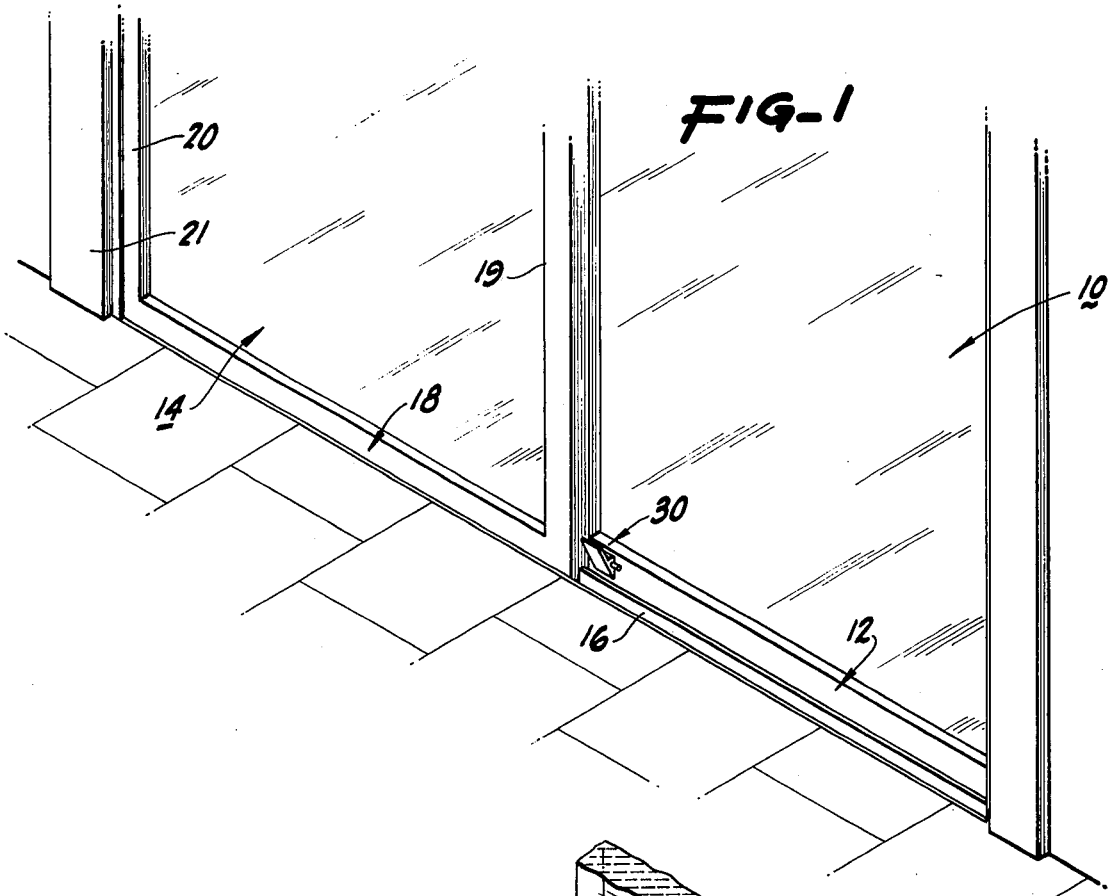
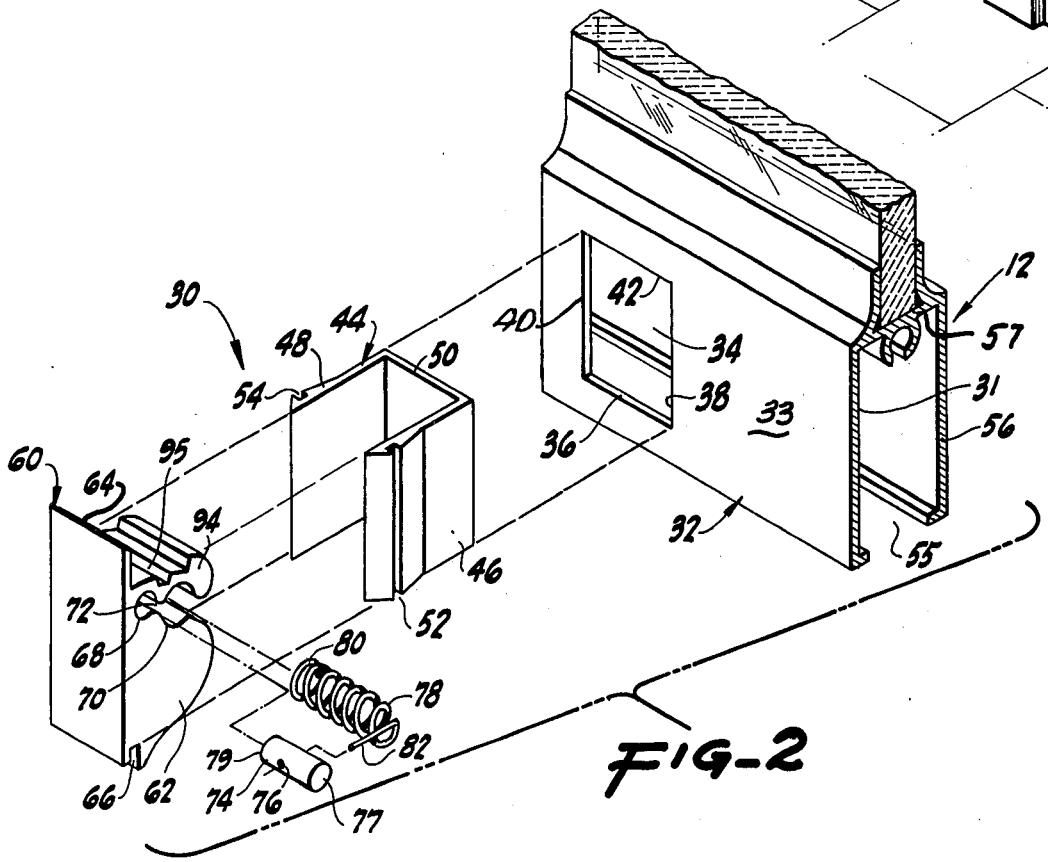
FIG-2

SECONDARY LOCK FOR SLIDING DOOR OR WINDOW

BACKGROUND OF THE INVENTION

Prior art of interest is Grossman, U.S. Pat. No. 2,941,832 for Sliding Door Lock and Adickes, U.S. Pat. No. 3,837,693 for Locks for Sliding Members.

A sliding vent, such as a door or window, is generally provided with a lock in the central portion of the lock stile thereof to immobilize the door or window. Although these primary locks provide a certain amount of security, clever thieves have learned how to open them; and while the market place and the patent literature afford numerous types of back-up devices, there is still considerable room for improvement.

SUMMARY OF THE INVENTION

The present invention relates to an improved secondary lock for a sliding door or window which is to be used in addition to an existing lock to provide greater security.

In brief, a secondary lock embodying the present invention includes a stop plate which is pivotally mounted on the bottom edge of a rectangular opening formed in the vertical panel, or flange, of a fixed bottom rail, and is rockable between an unlocked position and a lock position in which further movement of the sliding door or window is prevented by abutment against the stop plate. A spring loaded pin protrudes from the stop pla to prevent the stop plate from being moved from the lock position to the unlocked position. Pushing the pin into the stop plate allows the stop plate selectively to be moved to the unlocked position.

It is an object of the invention to provide a secondary lock for a sliding door or window which prevents entry by an unauthorized intruder who has disabled the primary lock.

It is another object of the invention to provide a secondary lock which is small in size yet is reliable in operation, inexpensive to manufacture and easy to install.

It is still another object of the invention to provide a generally improved secondary lock.

Other objects, together with the foregoing, are attained in the embodiment described in the following description and illustrated in the accompanying drawings.

BRIEF DESCRIPTION OF THE DRAWINGS

FIG. 1 is a fragmentary perspective view of a sliding vent, such as a door or window, and a fixed vent having installed thereon a secondary lock embodying the present invention;

FIG. 2 is a fragmentary, exploded, perspective view of the secondary lock to an enlarged scale;

DESCRIPTION OF THE PREFERRED EMBODIMENT

Figure 3:
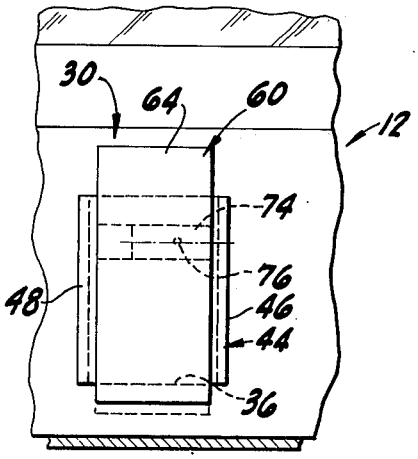
FIG. 3 is a front elevational view to an enlarged scale, of the secondary lock in an unlocked position.

While the secondary lock of the invention is susceptible of numerous physical embodiments, depending upon the environment and requirements of use, substantial numbers of the herein shown and described embodiment have been made, tested and used, and all have performed in an eminently satisfactory manner.

With especial reference to FIG. 1, a typical installation of a sliding closure, such as a door or window, includes a fixed vent 10 having a bottom rail 12. A sliding vent 14 is slidable on a track 16 or rail parallel to the fixed vent 10. The sliding vent 14 includes a horizontal bottom rail 18 and a vertical bumper stile 19 upstanding from the bottom rail 18.

A conventional primary lock (not shown) is provided in the central portion of the lock stile 20 to connect the sliding door 14 to the customary lock jamb 21.

A secondary lock, generally designated by the referene numeral 30, embodying the present invention, is provided in the fixed bottom rail 12 in such a manner that in a lock position, as shown in FIG. 1, the bumper stile 19 of the slidable vent 14 abuts the secondary lock 30 upon movement of the sliding door 14 in a right hand direction and thus prevents any movement of the sliding door 14 substantially beyond the position shown in FIG. 1 even though the primary lock has been rendered inoperative.

As most clearly appears in FIG. 2, the fixed bottom rail 12 is constructed in channel form and includes a front panel 32, or plate, with an outer surface 33 facing the sliding door 14 and a back or inner surface 31. A rectangular opening 34 or hole, is cut through the panel 32, the aperture 34 being defined by a bottom or pivot edge 36, a pair of vertical side edges 38 and 40, perpendicular to the pivot edge 36, and a top edge 42.

A housing 44 constituting part of the secondary lock 30 is inserted through and snap fitted into the rectangular opening 34. The housing 44 has vertical parallel, first and second walls 46 and 48 which extend perpendicularly into the fixed bottom rail 12 from respective edges 38 and 40. The walls 46 and 48 are connected by an end wall 50, and are formed with oppositely facing grooves 52 and 54 into which the respective edges 38 and 40 intrude to fix the housing 44 to the channel plate 32.

Figure 4:
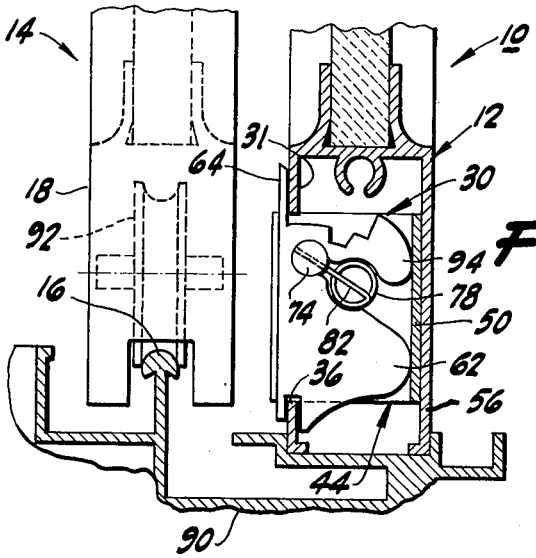
FIG. 4 is a sectional view, to an enlarged scale, of the secondary lock in unlocked position, showing the relative location of the bottom rails of the fixed vent and the slidable vent.
Figure 6:
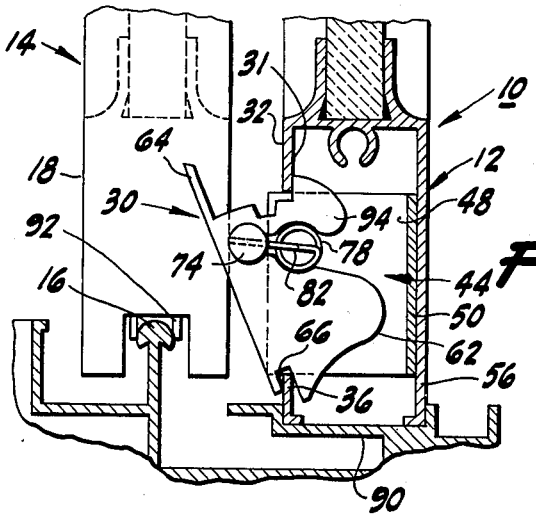
FIG. 6 is a view comparable to FIG. 4 but with the secondary lock in lock position; and, FIG. 7 is a plan view of an alternate horizontal installation of the secondary lock in the side wall of the fixed bottom rail.

In installed position, the housing 44 protrudes into the elongated chamber 55 defined by the outer panel 32, inner panel 56 and web 57 of the channel shaped bottom rail 12. As shown in FIGS. 4 and 6, the end wall 50 of the housing 44 abuts the inner panel 56 when the housing is installed.

A stop member 60 comprises a lock body 62 formed with a stop plate 64 at its upper, outer end. The lock body 62 is formed with a longitudinal groove 66 in its lower end into which intrudes the pivot edge 36 and is longitudinally of such length as to fit snugly between the walls 46 and 48 of the housing 44. By this means, the stop member 60 is rockable to and fro in a direction parallel to the planes of the walls 46 and 48 of the housing 44. The lock body 62 is formed with a pin retaining hole 68 and a spring retaining hole 70 which are parallel to the groove 66 and longitudinally extend completely through the lock body 62.

A slot 72 bridges the holes 68 and 70 so that the holes 68 and 70 communicate throughout their length. A pin 74 is slidable in the hole 68 and is formed with a diametral hole 76 located intermediate the right hand end 77 and the left hand 79 of the pin 74, as viewed in FIG. 2. A compression spring 78 is retained in the hole 70 and has one end 80 abutting against the second wall 48 of the housing 44. The other end 82 of the spring 78 is bent perpendicular to the longitudinal axis of the spring 78 and extends through the slot 72 into the diametral hole 76 of the pin 74. The spring 78 thereby urges the pin 74 in a right hand direction, causing the right end portion 77 of the pin 74 to protrude from the lock body 62 by an amount determined by the free length of the spring 78.

Figure 5:
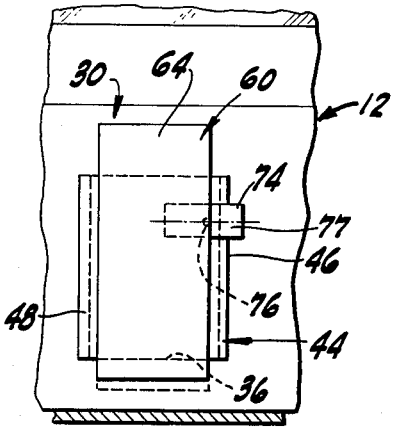
FIG. 5 is a view comparable to FIG. 3, but showing the secondary lock in lock position.

FIGS. 5 and 6 illustrate the secondary lock 30 in lock position with the pin 74 in interfering relation with the adjacent wall 46 of the housing 44.

The spatial relationship between the fixed vent 12 and the slidable vent 14 most clearly appears in FIGS. 4 and 6, the bottom rail 18 of the sliding door 14 being preferably provided with a roller 92 which rolls on the track 16 integrally formed with a bottom frame 90 of the door or window installation.

In order to move the lock member 60 from retracted, unlocked position shown in FIG. 4 into projected, or locked, position in FIG. 6, the lock body 62 is rocked counterclockwise with the bottom edge 36 of the aperture 34 as a pivot so that the stop plate 64 is disposed in the path of the portion of the bumper stile 19 which is connected to the bottom rail 18 of the sliding door 14. In this manner, if it were attempted to slide the sliding door 14 rightward in FIG. 1, the bumper stile 19 would abut the left hand edge of the stop plate 64. The sliding door 14 is therefore locked in a closed position as illustrated in FIG. 1.

Referring again to FIGS. 5 and 6, in the outwardly protruding lock position of the secondary lock 30, the end portion 77 of the pin 74 protruding from the lock body 62 is disposed between the plane of movement of the sliding door 14 and the plate 32 of the fixed bottom rail 12. Any attempt to rock the lock body 62 clockwise from the locked position shown in FIG. 6 into the fixed bottom rail 12 as in FIG. 4 would cause the pin 74 to abut the adjacent edge of the first wall 46 of the housing 44. It is therefore impossible to move the lock body 62 from the locked position to the unlocked position without pushing the pin 74 into the lock body 62.

The lock body 62 is also formed with a limit stop portion 94 which abuts the back surface 31 of the plate 32 of the fixed bottom rail 12 when the lock body 62 is in the locked position. The limit stop 94 thus serves in conjunction with the snap fit between the lock body 62 and the plate 32 to prevent the lock body 62 from being detached from the fixed bottom rail 12 once assembly is effected. In the process of installing the lock body, the longitudinal recess 95 in the top of the lock temporarily receives the top edge 42 of the aperture 34 so that the groove 66 can be positioned over, then lowered, to receive the bottom edge 36 of the aperture 34.

To move the lock body 62 from the projected, locked position shown in FIG. 6 to the unlocked, retracted position shown in FIG. 4 the pin 74 is pushed longitudinally into the lock body 62 until the pin clears the underlying edge of the first wall 46. The lock body 62 is then rocked in a clockwise direction, as appears in FIG. 4, into the housing 44 until the top plate 64 abuts the adjacent portion of the channel plate 32. Concurrently, the right hand end 77 of the pin 74 (as viewed in FIGS. 2 and 5) abuts and slides along the first wall 46 of the housing 44. With the secondary lock 30 in the unlocked position shown in FIG. 4, the sliding door 14 will clear the stop plate 64 and is free for movement.

Figure 7:
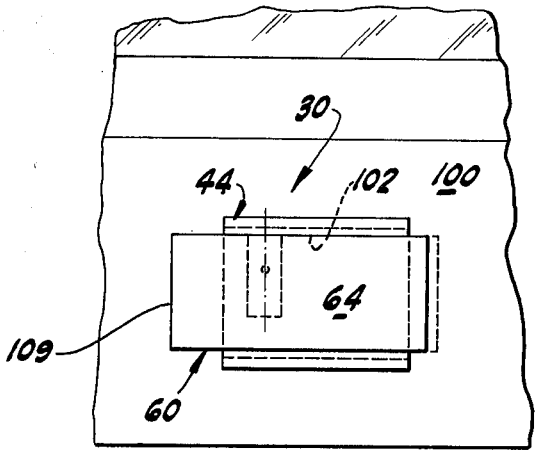

FIG. 7 illustrates a modified installation of the secondary lock 30 in a panel 100 parallel to and adjacent a sliding door or window (not shown). In this case, horizontally elongated opening 102 is formed in the panel 100 to receive the housing 44. The secondary lock 30 is snapped into the housing as before except that the lock body 62 is rockable in a horizontal rather than a vertical plane. With this arrangement, the sliding vent abuts the vertical left hand edge 109 of the stop plate 64.

It can therefore be seen that I have provided a lock which is not only versatile, in that it can be positioned either in vertical or horizontal attitude, but which is economical and compact in size, yet reliable, and which can readily be installed even by unskilled personnel since the major components are snap-fitted into place.

What is claimed is:

1. A lock for a sliding closure including a sliding vent movable in a plane parallel to a fixed vent having a panel with a front surface facing said plane and a back surface, the panel being formed with a rectangular aperture defined by a plurality of edges including a pivot edge, said lock comprising:

a. a stop member pivotally mounted on said pivot edge and being rockable between an unlocked position in which said sliding vent clears said stop member upon opening movement of said sliding vent and a locked position in which said sliding vent is immobilized by engagement with said stop member, said stop member including a pin retaining hole formed therein parallel to said pivot edge of said aperture in said panel, said stop member further including a spring retaining hole formed therein in a direction parallel to said pin retaining hole, said stop member being further formed with a slot connecting said pin retaining hole and said spring retaining hole;

b. a pin slidable in said pin retaining hole;

c. a compression spring housed in said spring retaining hole in said stop member urging one end of said pin to protrude from said stop member, said one end of said pin protruding from said stop member and being laterally disposed between said front surface of said panel and said plane when said stop member is in locked position, said spring being connected to said pin through said slot; and, d. a housing having first and second parallel walls perpendicularly extending from said back surface of said panel from the edges of said panel defining said rectangular aperture which are perpendicular to said pivot edge, said stop member being rockable between and in a direction parallel to said first and second walls;

said one end of said pin being urged by said spring into abutment with said first wall when said stop member is in unlocked position; an end of said spring abutting said second wall in both unlocked and lock position of said stop member.

2. A lock as in claim 1 in which said stop member is formed with a limit stop portion abutting said back surface of said panel when said stop member is in locked position.

3. A lock as in claim 1 in which said stop member is formed with a groove into which said pivot edge intrudes to form a pivot for said stop member.

4. A lock as in claim 1 in which said first and said second walls are formed with oppositely facing grooves into which intrude the edges of said aperture in said panel perpendicular to said pivot edge.

5. A lock as in claim 1 in which said housing further includes an end wall connecting said first and second walls.

6. A lock as in claim 1 in which said stop member includes a side perpendicular to said pivot edge and in which said slidable vent abuts said side of said stop member perpendicular to said pivot edge when said stop member is in locked position.

7. A lock as in claim 1 in which said stop member includes an edge parallel to said pivot edge and in which said slidable vent abuts said edge of said stop member parallel to said pivot edge when said stop member is in locked position.

8. A lock for a sliding closure including a sliding vent movable in a plane parallel to a fixed vent having a panel with a front surface facing said plane and a rear surface, the panel being formed with a rectangular aperture defined by a first edge, a pair of side edges and a pivot edge, said lock comprising:

a. a housing including first and second parallel walls extending rearwardly from said side edges of said aperture, said parallel walls including front edges formed with oppositely facing grooves into which said pair of side edges intrude so as to secure said housing to said side edges;

b. a stop member pivotally mounted on said pivot edge of said aperture and being rockable between an unlocked position in which said stop member is located within said housing, so that said sliding vent clears said stop member upon opening movement of said sliding vent, and a locked position in which at least a portion of said stop member protrudes from said housing into interfering engagement with said sliding vent for immobilizing the same against opening movement beyond said stop member, said stop member being formed with a pin retaining hole parallel to said pivot edge, a spring retaining hole parallel to said pin retaining hole, and a slot connecting said pin retaining hole and said spring retaining hole;

c. a pin slidable in said pin retaining hole, said pin being movable between a retracted location when said stop member is in unlocked position and a projected location in abutment with the front edge of one of said parallel walls when said stop member is in locked position; and, d. a spring disposed on said spring retaining hole, said spring being confined between said first and second parallel walls in both unlocked and locked position of said stop member, one end of said spring being connected to said pin and movable in said slot for urging said pin from said retracted location toward said projected location as said stop member is moved from said unlocked position toward said locked position.

9. A lock as in claim 8 including limit stop means on said stop member for restricting the extent of movement of said stop member as said stop member is moved from said unlocked position toward said locked position.

* * * * *